US006394621B1

(12) United States Patent
Hanewinkel, III

(10) Patent No.: US 6,394,621 B1
(45) Date of Patent: May 28, 2002

(54) LATCHING SWITCH FOR COMPACT FLASHLIGHT PROVIDING AN EASY MEANS FOR CHANGING THE POWER SOURCE

(76) Inventor: William Henry Hanewinkel, III, 1332 Dover Rd., Salt Lake City, UT (US) 84108

( * ) Notice: Subject to any disclaimer, the term of this patent is extended or adjusted under 35 U.S.C. 154(b) by 0 days.

(21) Appl. No.: 09/539,128

(22) Filed: Mar. 30, 2000

(51) Int. Cl.[7] ..... F21L 4/04
(52) U.S. Cl. ..... 362/200; 362/201; 362/203
(58) Field of Search ..... 362/200, 800, 362/201–205, 116, 187, 188, 35, 372; 200/60, 316, 313, 317, 310

(56) References Cited

U.S. PATENT DOCUMENTS 1,511,046 A * 10/1924 Barany ..... 362/200
3,057,992 A * 10/1962 Baker ..... 362/200
3,206,594 A * 9/1965 Brown ..... 362/200
4,442,478 A * 4/1984 Stansbury ..... 362/200
5,121,308 A * 6/1992 Maglica et al. ..... 362/187
5,475,368 A * 12/1995 Collins ..... 340/573
5,558,429 A * 9/1996 Cain ..... 362/155
5,893,631 A * 4/1999 Padden ..... 362/201

* cited by examiner

*Primary Examiner*—Sandra O'Shea
*Assistant Examiner*—Bao Truong
(74) *Attorney, Agent, or Firm*—Allen C. Turner

(57) ABSTRACT

A latching power switch for a light emitting diode ("LED") flashlight is disclosed which includes a vessel comprising upper and lower components for receiving and containing a lithium cell battery, a means of using the anodic and cathodic leads from the LED, an aperture provided through the said vessel, and a switching mechanism comprising a rotating cam movable through the vessel aperture. The switching device comprises an on-off switch. The switch operates by rotating a biwire LED in which its leads are formed to surround a lithium coin cell power source. The LED wire leads pass through holes in an electrically non-conductive cam which has both a protuberance for operating the cam and a lobe for latching against a surface of the aperture through which it passes. The cam latches the wire leads against their proper corresponding coin cell surfaces thus activating the circuit and causing the illumination of the LED.

20 Claims, 2 Drawing Sheets

LATCHING SWITCH FOR COMPACT FLASHLIGHT PROVIDING AN EASY MEANS FOR CHANGING THE POWER SOURCE

TECHNICAL FIELD

The invention relates generally to latching switch mechanisms and more particularly to a switch mechanism for a compact light emitting diode ("LED") flashlight device.

BACKGROUND

During the past few years, the brightness of LED technology has improved to allow for their use in small personal flashlight devices. Many of these devices are simply packaged in plastic housings utilizing momentary switches, and are meant to be disposable once the battery source is depleted. One example of this is the ADVA-LITE™ Tag Lite. The use of lithium "coin cell" batteries, such as the EVEREADY™ CR2032, as a power source, has improved the state of the art of these miniature flashlight designs. Such coin cells are of relatively high voltage (e.g., 3 volts), compact, inexpensive, and reliable (>5 year storage life). Most, if not all, of these devices utilize a switch design which places the LED bi-wire leads across each polarity of the coin cell battery. One LED wire lead continually contacts its corresponding battery surface, while a means is provided to press the opposite LED wire lead against the corresponding battery surface to activate the circuit. The spring tension in the wire lead or a foam button are the usual means used to return the circuit to an off condition. In U.S. Pat. No. 5,893,631 to Padden (Apr. 13, 1999), a plastic spring that is integral to the coin cell carrier is used to return the circuit to an "off" condition.

Because the LED component is very reliable (50,000–100,000 hours), the state of the art has changed to provide a means for replacing the depleted power source. Another improvement has been the use of "latch-on" type of switch mechanisms so as to free up the users hands while using the flashlight. An example of this is the PHOTON MICROLIGHT II™ of L.R.I., of Blachly, Oreg., U.S.A. (see, e.g., U.S. Pat. No. D375372 to Allen (Nov. 5, 1996)).

As in the case of the PHOTON MICROLIGHT II™ product, an effort has been made to create a low-cost manufacturable design which requires the use of the LED biwire leads to surround the coin cell. One LED wire lead continually contacts its corresponding battery surface while a means is provided to press the opposite LED wire lead against its corresponding battery surface to activate the circuit.

The current state of the art using a LED, coin cell, and LED wire leads as key components of the switch mechanics, leads to a difficulty in replacing the battery source. As in the case of the PHOTON MICROLIGHT II™ product, four #0 screws are removed and the entire assembly dismantled to change the coin cell. All of the components are then reassembled properly to assure the flashlight will operate again. Padden's design (U.S. Pat. No. 5,893,631) is simpler in that the battery carrier can be removed to replace the cell, but in this example, it is still a momentary switch design. Another aspect of this type of switch design is that the wire lead could potentially be damaged through metal fatigue due to the bending action. The manufacturing standard for most if not all LEDs is to use tin plated steel wire leads.

In summary, none of the current state of the art in LED flashlights is believed to contain both a convenient means of changing the power source along with a latching switch mechanism.

SUMMARY OF THE INVENTION

The invention describes a very compact flashlight with a latching switch and means to easily change the battery storage. The lamp is a standard flanged LED which has bifurcated electrical leads. The lamp is centered at one end in an injection molded plastic housing which comprises two parts fastened to form a vessel. One end of the vessel has an aperture to allow the light emitting end of the lamp to pass therethrough. Within the vessel base are cylindrically shaped saddles for the lamp to set in and rotate upon. Also within the vessel are protruding cylindrically shaped walls to constrain the coin cell battery which sits between the bifurcated LED leads. The vessel also has additional apertures for the passing through of the gripping protuberance of the switch cam and an aperture for changing the coin cell battery. A cam made of electrically nonconducting plastic and formed with two through holes is assembled to the LED by sliding it over the LED's bifurcated leads. The LED leads are then bent to fasten the cam to the LED but also to provide a minute clearance for the leads to surround the anode and cathode surfaces of the coin cell. The perimeter of the cam has two mechanical features to form a gripping protuberance and a lobe for locking the cam in one of two positions. The LED lead clearance around the coin cell battery is an improvement in that neither lead needs to be touching the anode or cathode surfaces of the battery in the off condition of the light which is a requirement for momentary switches in LED flashlight designs. In addition, the LED lead clearance also allows the coin cell to be readily replaced without total disassembly of the flashlight. A small plastic interlocking panel closes the side aperture to the flashlight to final constrain the coin cell. The interlocking panel can be removed by a simple prying motion on one edge so that a fresh coin cell can be exchanged for the depleted one.

To illuminate the flashlight, one pushes on the cam's protuberance grip, thereby imparting a rotational motion on the LED and its bifurcated leads. Upon rotation, the bifurcated leads come into contact with their respective anode and cathode surfaces of the coin cell illuminating the LED. As the cam continues to rotate, a lobe on the cam starts to pass through the vessels aperture. A deflection, consisting of the upper vessel wall and clearances around the LED saddles and LED, occurs, allowing the lobe to pass through the aperture and over center the cam. The cam's lobe shape transitions to a flat surface as the lobe passes through the vessel aperture, resting against its corresponding aperture side wall and temporarily latches the cam into position thus maintaining the bifurcated LED lead contacts to the coin cell. Residual spring tension in the LED leads provides sufficient contact pressure to sustain electrical current flow between the coin cell and LED leads while maintaining back pressure on the cam. By reversing the cams rotation, the cam's lobe once again passes through the aperture, switching and latching the flashlight off.

The invention provides a latching switch mechanism for LED flashlights while maintaining an easy means of changing battery storage by rotating a LED of biwire design such that the anode and cathode leads contact their corresponding surfaces of a coin cell battery.

The invention also provides a circuit in which neither wire lead from a bifurcated lamp needs to continually maintain contact with the power source while in the off condition.

Equally important, the invention provides a switch mechanism that latches the circuit on, so as to free the flashlight users hands.

The invention also provides a flashlight switch and assembly that are inexpensive to manufacture.

The invention also provides a personal flashlight with multiple uses by maintaining a planar surface on one side of the flashlight casing so that the device can be stabilized on a surface or so that attaching mechanisms can be added. Attaching mechanisms can be devices such as magnets, VELCRO™ (hook and loop fastener) or adhesive.

The invention also can provide a personal flashlight with multiple uses by providing a hole through the flashlight casing for a lanyard or loop attachment.

BEST MODE OF THE INVENTION

Figure 1:
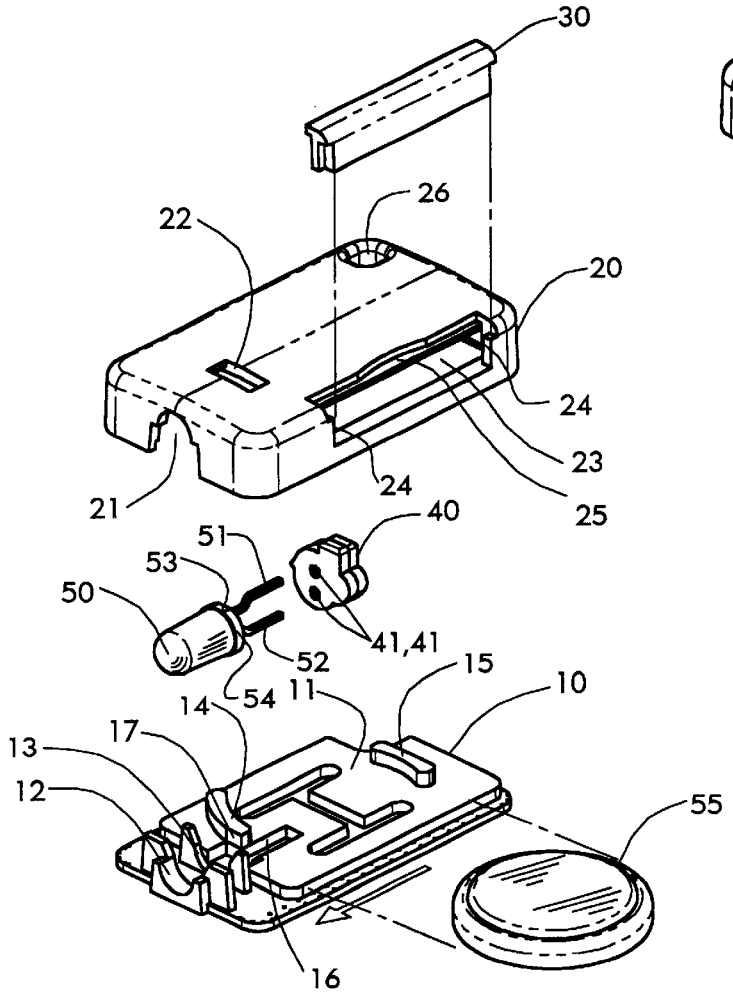
FIG. 1 is an exploded view of the compact flashlight assembly.
Figure 2:
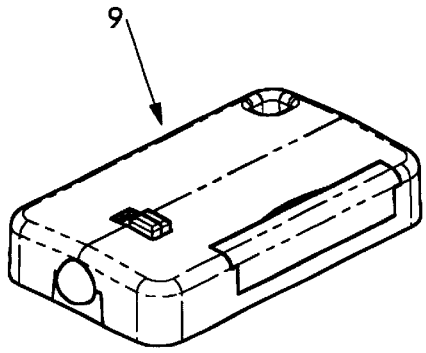
FIG. 2 is a perspective view of the compact flashlight assembly in its entirety.
Figure 4:
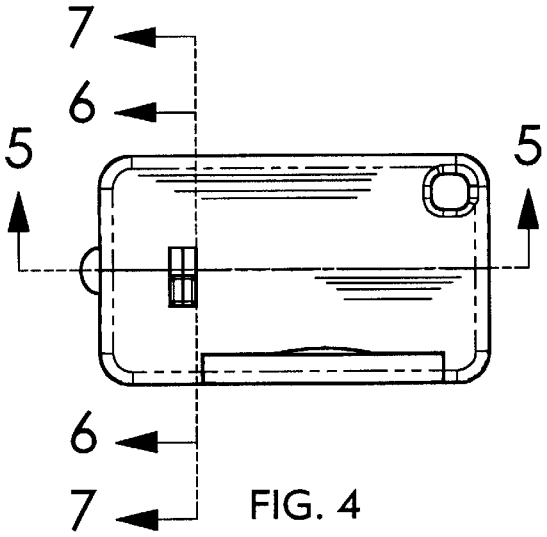
FIG. 4 is a top view of the invention.

With reference to FIGS. 1, 2, and 4, the overall flashlight, generally 9, of the invention is a self-contained unit. The flashlight assembly includes a base 10 upon which are formed or associated saddles 12, 13, raised planar surface 11, and radial walls 14, 15. The saddles 12, 13 have a predetermined radius so that the cylindrical body of a LED 50 or equivalent structure can set into and precisely rotate thereupon. Raised surface 11 and two radial walls 14, 15 form a constraint to hold coin cell 55 and to prevent its moving fore, aft, and in one lateral direction relative to LED 50. Fitted to or associated with the LED 50 is cam 40 having holes 41 through which the biwire leads 51, 52 of the LED can pass. The biwire leads 51, 52 are then formed as shown to provide both a fastening of the cam to the LED and also a minute clearance for the leads to surround the anode and cathode surfaces of the coin cell to fit about coin cell 55. A cover 20 is fitted over the base 10, LED 50, and cam 40 and is preferably permanently fastened to base 10 using adhesive or ultrasonic welding. This fastening could also be accomplished with small threaded fasteners.

The flashlight body including base 10 and cover 20, forms a vessel into which coin cell 55 is installed through aperture 23 and is closed off by the battery closure panel 30. The internal height of the assembled body 10, 20 is such that a coin cell can be inserted and removed easily but still constrains the coin cell from movement in a vertical direction. The circuit is activated by rotating cam 40 which imparts a rotation upon the LED 50 and its leads 51, 52 to a point in which the two leads are making contact to their corresponding surfaces of coin cell 55 illuminating the LED.

Figure 9:
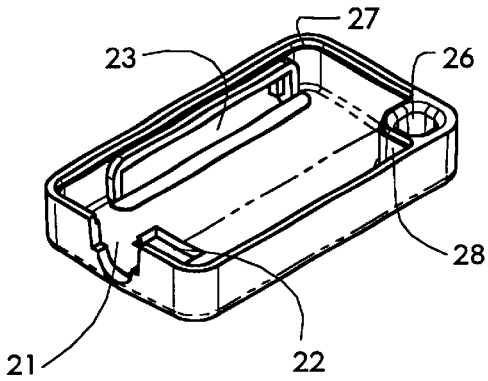
FIG. 9 is a perspective view of the upper vessel of the flashlight.

Referring now to FIGS. 1 and 9, cover 20 has three apertures, to wit, cam aperture 22, battery aperture 23, and bulb aperture 21. Aperture 22 allows for protuberance 42 of cam 40 to pass through and, additionally, is sized precisely so that cam 40 cannot move significantly fore and aft and also constrains the rotation limits of the cam. Bulb aperture 21 allows for LED 50 to pass through and is precisely sized to secure the LED 50 but allow its rotation with a minimum of fore and aft rocking motion or vertical pitching motion. Aperture 23 allows for the passing through to the inside of the flashlight the coin cell 55. Recessed step 27 which follows the perimeter bottom surface of cover 20 self locates base 10 at assembly prior to fastening these two components together.

Figure 5:
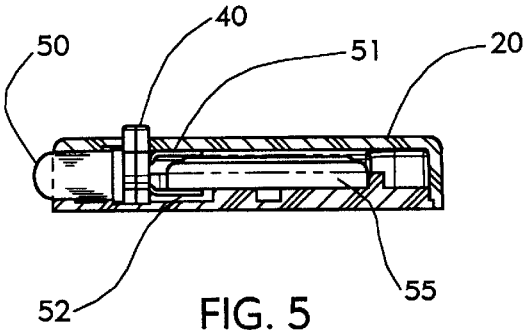
FIG. 5 is a cross-sectional view of FIG. 4 depicting the assembled upper and lower vessel components, the LED, the battery, and the cam actuator.

The cam 40 and LED 50 are assembled as described hereinabove and the lead wires 51, 52 are preferably bent as depicted in FIGS. 1 and 5. The position of this subassembly, in the circuit off position, is with the LED surface 53 parallel with base surface 11. This places lead wires 51 and 52 overtop of one another co-perpendicular to surface 11. With the LED lead wires in the off position, their respective shapes are such as to fit about the upper and lower surfaces of the coin cell 55. The clearances around the coin cell are minute but could still function correctly if one of either biwire lead contacts its corresponding coin cell surface. The lead wires 51, 52 come into contact with their respective coin cell surfaces when the cam 40 is rotated axially about the LED.

Figure 8:
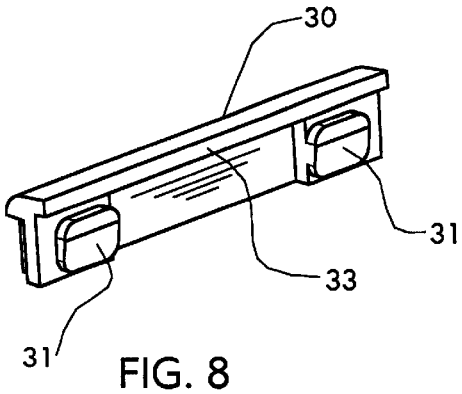
FIG. 8 is a perspective rear view of the battery closure panel.

Extending from around aperture 23 are the side walls 24 and shelf 25. These features interlock with mating surfaces on the battery cover 30 to create a temporarily locking cover which retains the coin cell 55 and constrains the coin cell 55 from moving laterally within the flashlight. Bosses 31 of closure panel 30 (FIG. 8) create the lower mechanical feature, and the edge 33 the upper mechanical feature to interlock with shelf 25 to the cover 20.

An electrically nonconductive material is preferably used for the makeup of the base 10, cover 20, and cam 40. These components would preferably be created using a plastic injection mold process.

Extending axially inward from the saddle 13 is a recess 16 which is sized to accept the cam 40 and lead 52 without interference. Moreover, the walls making up the fore and aft walls of the groove are precisely sized to prevent fore and aft motion of the LED 50 and the cam 40. These fore and aft walls are located to the aft side of saddle 13 and surface 17 on radial wall 14. In particular, the walls capture the LED flange 54 and the aft side of cam 40.

Through the hole 26 on one corner of the cover 20 provides an attachment lug for a lanyard or keychain. Integral wall 28 (FIG. 9) is provided within the cover 20 for the hole 26 to ensure good strength.

Figure 3:
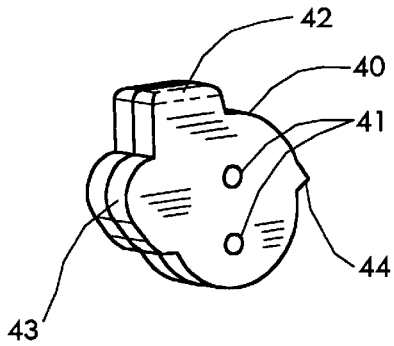
FIG. 3 is a perspective view of the cam actuator.
Figure 6:
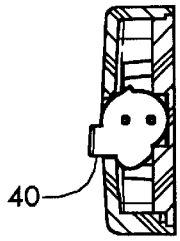
FIG. 6 is a cross-sectional view of FIG. 4 depicting the cam actuator within the flashlight body in its circuit off position.
Figure 7:
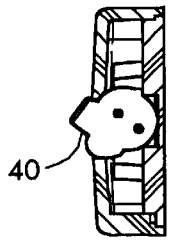
FIG. 7 is a cross-sectional view of FIG. 4 depicting the cam actuator within the flashlight body in its circuit on position.

FIG. 3 depicts the detail of preferred cam 40. Protuberance 42 provides a gripping feature for the rotation of the cam. Extending from the cam body is step 44 which is an extra rotational stop and engages surface 11 at one rotational limit to prevent final rotation of cam 40 and LED 5 in the assembly. Additionally, protruding curve and slope 43 engage with one side wall of aperture 22 to prevent the unintentional rotation of the cam while providing an over center flat surface to latch the cam in the circuit on position. The flat side surfaces of aperture 22 engages the flat surface of a protuberance 42 in the circuit on position. FIGS. 6 & 7 depict the cam 40 in its circuit on and circuit off positions respectively. Residual tension within LED leads 51 & 52 maintain the necessary forces to maintain contact with their respective surfaces of coin cell 55.

It is also preferred that the light source 50 be a LED having a predetermined color and integral lense which will become illuminated with a relatively small voltage. A battery suitable for use with the LED is a 3.0 volt lithium coin cell battery.

Although the invention has been described with reference to certain preferred embodiments and depicted configurations, these are illustrative only, and the scope of the invention is to be determined with reference to the appended claims.

What is claimed is:

1. A flashlight comprising:

a flat housing sized and shaped to receive a battery therewithin and having a side, front and top apertures;

a LED having bifurcated wire leads, said LED operably associated with said flat housing in a rotatable relationship, said wire leads extending into said flat housing through at least one aperture in said flat housing; and a battery contained within said flat housing, said battery accessible through a side aperture in said flat housing, said battery constrained within said flat housing in such a manner that when said LED is rotated, electrical contact is made simultaneously with said battery's sides causing powering of said LED and consequently illumination thereof.

2. The flashlight of claim 1 further comprising a cover for closing the battery access side aperture.

3. The of flashlight claim 1 wherein said flat housing is comprised of a lower and an upper section halves permanently affixed to one anther.

4. The flashlight of claim 3 further comprising a rotating cam of an electrically nonconducting material and having holes through which the LED bifurcated leads pass and whereby rotation of said cam imparts a rotational motion to the LED.

5. The flashlight of claim 4 wherein said cam has a protuberance for manual actuation and said flat housing has an upper aperture allowing the protuberance to pass through to the outside for access.

6. The flashlight of claim 4 wherein said cam has a lobe shape whereby rotation of the cam in a first position provides an over center set against one side of the upper aperture in the said flat housing to maintain the LED biwire leads in contact with the battery's sides without external forces.

7. The flashlight of claim 4 wherein the cam has two holes which allows passage of the two LED biwire leads and which creates a sub-assembled component made up of the cam and the LED.

8. The flashlight of claim 2 wherein the cover has a groove created between 2 protruding bosses on its inner broad surface that engages a thin shelf on the said flat housing and 2 protruding bosses on each long end of the cover that are constrained against similar features on the said flat housing which creates a temporary retention of the cover to the said flat housing.

9. The flashlight of claim 8 wherein the cover, when associated with said flat housing, maintains the battery's lateral position in one direction.

10. The flashlight of claim 2 wherein the lower shell section of said flat housing comprises a planar surface for the sliding action of one surface of the battery.

11. The flashlight of claim 10 wherein the lower section of said flat housing further comprises a pair of radially shaped protruding walls extending therefrom, said radially shaped walls keeping the lateral position of the battery constant relative to the LED and said cam.

12. The flashlight of claim 10 wherein the lower section of said flat housing further comprises a stepped surface about its perimeter for self locating with a corresponding stepped surface feature in the upper section of the said flat housing.

13. The flashlight of claim 10 wherein the lower section of said flat housing further comprises a pair of protruding saddles for holding and locating the LED and cam subassembly thus allowing for the precise rotation of the LED.

14. The flashlight of claim 2 wherein the upper section of said flat housing has a front aperture of a half circle shape for allowing pass through of the LED and for keeping the said LED and cam subassembly in the saddles of the lower section of said flat housing upon permanent mating of the upper and lower sections of said flat housing.

15. The flashlight of claim 14 wherein the upper section of said flat housing in conjunction with said lower section of said flat housing is oriented such as to maintain the vertical position of the said battery relative to the LED.

16. The flashlight of claim 15 wherein the upper section of said flat housing has a top surface having three apertures for closing the flat housing and containing the battery, the LED, and cam subassembly.

17. An improvement in a flashlight of the type having a light emitting diode ("LED") having LED biwires, said LED, upon actuation, powered by a battery, said battery contained within a flat housing, which flat housing orients the LED and LED biwire, so that, upon completion of a circuit between said LED biwires and said battery, light is emitted in a direction along a generally longitudinal axis of the flashlight, the improvement comprising:

actuating the flashlight by rotating the LED axially about the longitudinal axis of the flashlight so as to bring the LED biwires into simultaneous contact with the electrodes of the battery, causing completion of a circuit between the LED and the battery causing said LED to emit light.

18. The improvement of claim 17 wherein the LED's biwires are contained within a cam associated with said flat housing in a movable relationship wherein the cam is movable in a first and a second direction, which cam, when moved in the first direction, brings the LED biwires into simultaneous contact with the respective electrodes of said battery, thus actuating said LED to emit light.

19. The flashlight of claim 1 wherein said battery is a single coin cell battery.

20. A flashlight comprising:

a housing sized and shape to receive a battery therewithin and having said, front and top apertures; said housing consisting of lower and upper section halves permanently affixed to one another;

a LED having bifurcated wire leads, said LED operably associated with said housing in a rotatable relationship with a rotating cam of an electrically non-conductive material, said rotating cam having apertures through which the bifurcated leads pass and wherein rotation of said rotating cam imparts a rotational motions to the LED, said bifurcated wire leads extending into said housing through at least one aperture in said housing; and a battery contained within said housing, said battery accessible through the said aperture, said battery constrained within said housing in such a manner that when said LED is rotated via said rotating cam, electrical contact is made simultaneously with said battery's sides causing powering of said LED and consequently illumination thereof.

* * * * *